US006722809B2

(12) United States Patent
Hamberger et al.

(10) Patent No.: US 6,722,809 B2
(45) Date of Patent: Apr. 20, 2004

(54) JOINT

(75) Inventors: Peter Hamberger, Stephanskirchen (DE); August Hipper, Rohrdorf (DE)

(73) Assignee: Hamberger Industriewerke GmbH, Stephanskirchen (DE)

( * ) Notice: Subject to any disclaimer, the term of this patent is extended or adjusted under 35 U.S.C. 154(b) by 0 days.

(21) Appl. No.: 09/984,016

(22) Filed: Oct. 25, 2001

(65) Prior Publication Data

US 2002/0057942 A1 May 16, 2002

Related U.S. Application Data

(63) Continuation-in-part of application No. 09/673,512, filed on Nov. 30, 2000, now Pat. No. 6,332,733.

(30) Foreign Application Priority Data

Dec. 23, 1999 (DE) ..... 199 62 830
Feb. 10, 2000 (DE) ..... 200 02 413
Apr. 25, 2000 (WO) ..... PCT/DE00/01277

(51) Int. Cl.[7] ..... F16D 1/00

(52) U.S. Cl. ..... 403/329; 403/230; 403/29; 403/26; 52/591.3; 52/591.5; 52/592.2

(58) Field of Search ..... 403/29, 13, 14, 403/230, 329; 52/591.3, 591.5, 592.2

(56) References Cited

U.S. PATENT DOCUMENTS 1,859,667 A * 5/1932 Gruner ..... 52/578
4,514,104 A * 4/1985 Taylor et al. ..... 403/14
4,898,326 A * 2/1990 Edwards et al. ..... 238/10 E
5,425,210 A * 6/1995 Zafir ..... 52/404.4
5,678,369 A 10/1997 Ishikawa et al.
5,699,601 A * 12/1997 Gilliam et al. ..... 29/278
5,768,850 A 6/1998 Chen
6,045,290 A * 4/2000 Nocievski ..... 403/231
6,076,424 A * 6/2000 McMurtrey et al. ..... 74/544
6,209,278 B1 4/2001 Tychsen
6,345,481 B1 * 2/2002 Nelson ..... 52/592.2

FOREIGN PATENT DOCUMENTS

| | | |
|---|---|---|
| EP | 0 698 162 B1 | 9/1998 |
| HU | P9901996 | 6/1997 |
| HU | P0105225 A | 9/1997 |
| WO | WO 00/47841 | 8/2000 |

* cited by examiner

*Primary Examiner*—Lynne H. Browne
*Assistant Examiner*—Aaron Dunwoody
(74) *Attorney, Agent, or Firm*—Oliff & Berridge, PLC

(57) ABSTRACT

A joint for two flat structural members, in particular floor panels, wherein a groove and tongue joint joining two flat structural members is provided functionally separate from a twistlock locking the two flat structural members. The twistlock is formed on one of the structural members, is spaced apart from the groove and tongue joint, and engages with a correspondingly formed engaging element of the other structural member. The locking is preferably formed both at the longitudinal edges and at the front edges of a rectangular structural member, such as a floor panel. The locking allows for a joint of the floor panels to occur in flat position, i.e. without twisting.

23 Claims, 6 Drawing Sheets

JOINT

This is a Continuation-in-Part of application Ser. No. 09/673,512 filed Nov. 30, 2000, now U.S. Pat. No. 6,332,733. The entire disclosure of the prior application(s) is hereby incorporated by reference herein in its entirety.

BACKGROUND OF THE INVENTION

1. Field of Invention

The invention relates to a joint for structural members, such as floor panels.

2. Description of Related Art

A joint floor for floor panels is for instance disclosed in EP 0 698 162 B1. In the case of this known, so-called "glue-free" joint, the adjacent circumferential edges of the panels are joined by a groove and tongue joint. There, the lower groove cheek of the one panel facing the contact face is extended beyond the vertical parting plane and comprises a locking projection at its end portion, the locking projection immersing in a corresponding recess of the tongue of the other floor panel. In order to facilitate the laying of the panels, the joint in the engaging portion of the extended groove cheek with the tongue is performed with play so that displacing of the panel along the longitudinal edges is rendered possible.

WO097/47834 A1 shows a generic joint in which, similar to the solution described above, the lower groove cheek of a floor panel is extended beyond the vertical parting plane and is provided with a projection which engages with a corresponding clamping recess of the tongue. Contrary to the solution initially described, the engagement between the extended groove cheek and the corresponding recess of the tongue is performed such that a force is exerted by this locking which presses the two floor panels towards each other perpendicular to the vertical plane.

In both solutions described above, the groove and tongue joint has a double function. The groove and tongue joint on the one hand ensures the accurately fitting positioning of the two floor panels relative to each other so that no gaps and projections occur and the required laying quality is guaranteed. The second function consists in ensuring this predetermined relative position by the non-positive or positive locking between the extended groove cheek and the tongue even in the case of strain on the floor or temperature and moisture fluctuations.

It is a problem with the known solutions that the extended groove cheek has to be resiliently deformed to perform the engagement between the locking elements. In the case of unfavourable conditions, for instance with excessive strain of the resilient lower groove cheek or in the case of swelling due to moisture and the influence of temperature, cracks may occur in the contact area of lower grove cheek with the pertinent floor panel so that the groove cheek can no longer fulfil the locking function described before. In addition, the quality of the fitting of the groove and tongue joint is aggravated in the case of such cracks occurring in the contact area, so that the accuracy required for correct floor laying is no longer guaranteed.

SUMMARY OF THE INVENTION

As compared to this, it is an object of the present invention to provide a joint for structural members, in particular floor panels, in which an accurately fitting relative position is ensured with a minimum of equipment required.

Pursuant to the invention, fitting and locking are assumed by two separate structural members. Fitting is performed conventionally via a groove and tongue joint while locking is performed via a twistlock formed at a distance to the groove and tongue joint and thus being functionally independent thereof. The twistlock may be formed at the tongue-side front face or at the groove-side front face of a floor panel.

In preferred embodiments, the twistlock is formed at a distance to the tongue and immerses in a recess at the lower, floor-side groove cheek which, contrary to the prior art, is not resilient. This means that both the tongue and the twistlock are passing the vertical parting plane between the structural members in horizontal direction and are each immersing in corresponding recesses of the opposite structural member. With these embodiments, it is of particular advantage that substantially less material has to be removed relative to the solutions initially described, so that the shaping process for processing the front faces is facilitated.

A particularly reliable locking, which is easy to be manufactured, is obtained when the twistlock is provided with a recess with which a projection at the bottom of the lower groove cheek engages. The contact area between groove cheek and twistlock is preferably designed as inclined face, so that, even with relatively great tolerances, the applying of a predetermined prestress force admitting the two structural members to move towards each other is ensured.

The twistlock advantageously extends along the lower side of the structural member, so that a high-quality visible and stepping surface can be produced.

It is of very particular advantage if a groove is formed between the twistlock and the tongue, the depth of which determines the resilience of the twistlock relative to the vertical parting plane. This means that the tension forces applied by the twistlock and the extraction forces for taking apart the structural members can easily be adapted to varying ambient conditions or materials by changing the depth of this groove.

The invention may for instance be used with laminate floors having a carrier plate of high-pressure or medium-pressure wood fibers. On principle, the glue-free joint pursuant to the invention may also be used with other floors, for instance parquet floors.

Another advantage of the joint pursuant to the invention consists in that the structural members can be joined and locked with each other by sliding along the floor face. In the case of the prior art initially mentioned it is, however, necessary to first of all incline one structural member relative to the other structural member so as to insert the tongue in the groove, and to subsequently cause locking by twisting to the plane position. This means that, by providing floor panels with the locking pursuant to the various exemplary embodiments of the invention, the laying of the floor can be performed in a substantially easier and quicker way.

The sliding faces along which the structural members are sliding during the locking process are preferably designed as inclined faces.

When the structural members are laid flatly side by side, preferably both the longitudinal edges and the side edges of the structural members are joined pursuant to the invention.

In addition to the locking described before, the structural members may also be glued.

In one exemplary embodiment of the invention, the tongue and the twistlock may be made so that the front face of one of the tongue and the twistlock extends further beyond the vertical parting plane than the front face of the other of the tongue and the twistlock. In another exemplary embodiment of the invention, the tongue and the twistlock may be made so that the front faces of the tongue and the twistlock extend substantially the same distance beyond the vertical parting plane.

Advantageous further developments of the invention are set forth in the various exemplary embodiments described herein.

BRIEF DESCRIPTION OF THE DRAWINGS

In the following, a preferred embodiment of the invention is explained in detail by means of schematic drawings.

DETAILED DESCRIPTION OF PREFERRED EMBODIMENTS

The invention will be explained in the following by means of a laminate floor.

Figure 1:
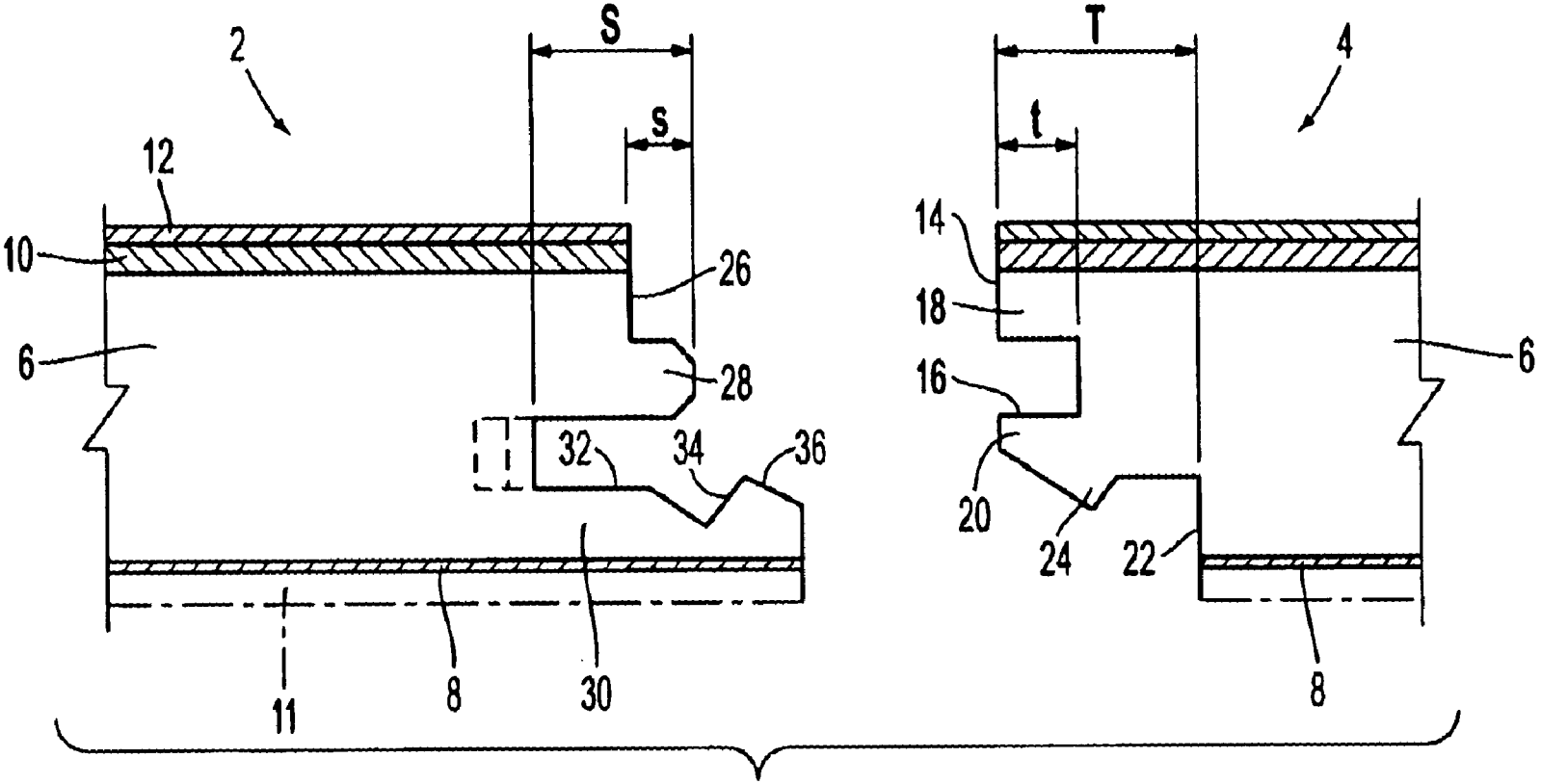
FIG. 1 illustrates the joint area of two floor panels.

Such a laminate floor consists of a plurality of floor members of which merely the joint area of two adjacent floor panels 2, 4 is illustrated in FIG. 1. Each floor panel 2, 4 of a laminate floor has a carrier plate 6—also referred to as core—consisting of high-pressure wood fibers. Such a carrier plate 6 ensures good dimensional stability and high resistance to pressure.

The floor face of each floor panel 2, 4 is formed by a countermove laminate 8 applied to the lower overall surface of each floor panel. In the case of particular applications, a moisture insulating sheet (not illustrated) may be incorporated. This countermove laminate 8 further increases the dimensional stability of the flooring material. As is illustrated in dot and dash in FIG. 1, a dead-sounding layer 11 for insulating structure-borne noise may be applied at the bottom of each floor panel 2, 4. The dead-sounding layer may be formed of conventional insulating materials, such as for instance polyurethane foam etc.

The visible surface of the floor panels 2, 4 is formed by a decorating laminate 10 and a cover layer 12 applied thereupon. The decorating laminate 10 is manufactured by printing and gives the floor an appearance that comes extremely close to the structure of natural wood floors. The cover layer 12 provides for the necessary robustness and wear resistance of the flooring material.

In the front face 14 of the floor panel 4 illustrated in FIG. 1, a rectangular groove 16 is formed which is limited by a higher groove cheek 18 and a lower groove cheek 20.

The lower portion of the groove cheek 20 which is spaced apart from the groove 16 is provided with a recess 22, the depth T of which is greater than the depth t of the groove 16. The remaining wall thickness of the groove cheek 20 is so great that its resilient deformation during the joint of the panel is practically negligible. At the lower side of the groove cheek 20 a projection 24 is provided which extends in the direction of the floor face of the floor panel 4. The side faces (perpendicular to the drawing plane) of the projection 24 are formed by inclined faces.

The front face 26 of the adjacent floor panel 2 is of corresponding construction. Accordingly, a tongue 28 corresponding to the groove 16 projects from the front face 26. The groove and tongue joint formed by the groove 16 and the tongue 28 corresponds to the joint of conventional laminate floors which are, for instance, joined by gluing only. In the area of the floor face of the floor panel 2, a twistlock 30 is formed which is separated from the tongue 28 via a front recess 32. This means that the side walls of the front recess 32 are on the one hand limited by the twistlock 30 and on the other hand by the tongue 28. The depth S of the front recess 32 is greater than the length s of the tongue 28—i.e. the groove bottom is displaced inwardly relative to the front face 26. By varying the depth S, the resilience of the twistlock 30 can be adjusted so that the extraction forces for dismantling the floor can be adapted.

The major area of the twistlock 30 which is spaced apart from the front recess 32 extends in prolongation of the floor face of the floor panel 2. In the face of the twistlock 30 facing the front recess 32, a notch 34 is provided which—as will be described in detail in the following—is engageable with the projection 24 of the recess 22 and is formed approximately below the front face of the tongue 28.

The front face of the twistlock 30 is provided with an inclined sliding face 36 which facilitates the joining of the floor panels 2, 4 in interaction with the adjacent inclined face of the projection 24.

For joining the floor panels 2, 4, the projection 24 slides on the sliding face 36 and the tongue 28 immerses in the groove 16. In this relative position, the lower groove cheek 20 in turn immerses in the front recess 32.

Figure 2:
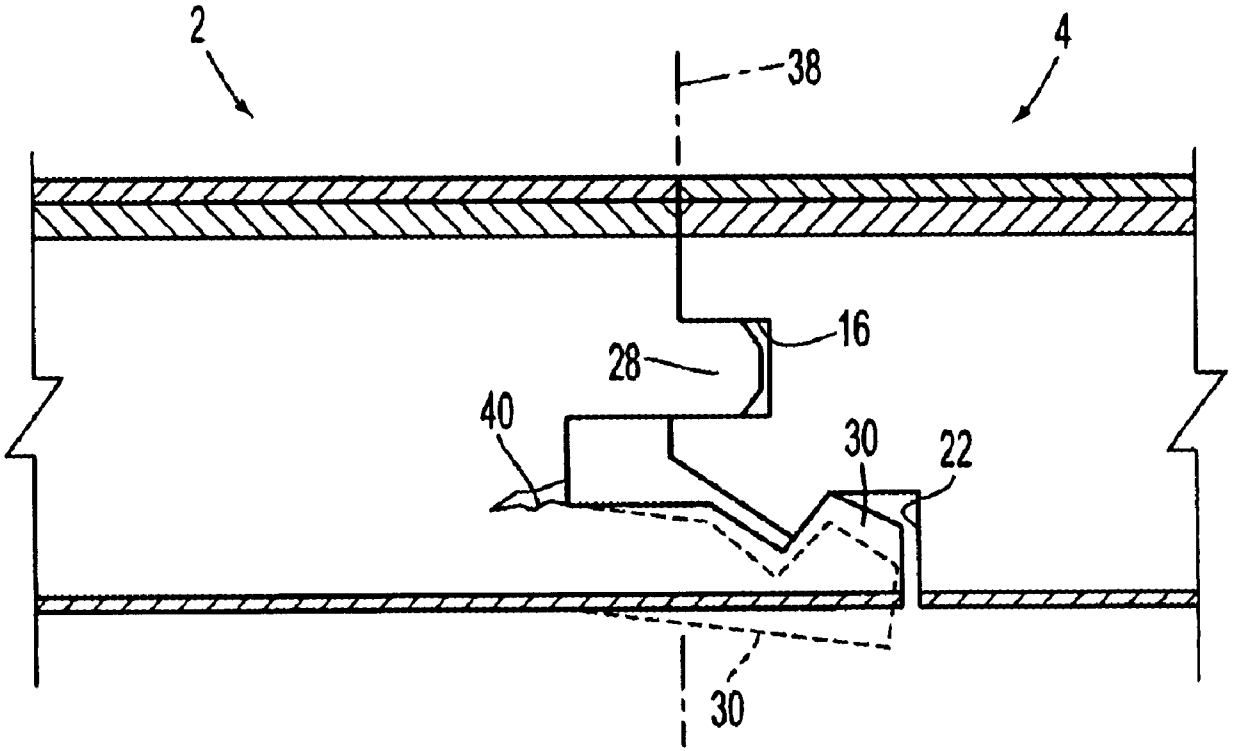
FIG. 2 illustrates the floor panels of FIG. 1 in a positively engaged state.

On further shifting of the floor panel 4 relative to the floor panel 2, the twistlock 30 is resiliently deflected downwards due to the transversal force introduced via the inclined sliding face 36 (FIG. 2, illustration in dot and dash). The sliding face 36 slides along the projection 24 until the latter catches with the notch 34. In this state, the twistlock 30 engages the projection 24, the contact between these two structural members merely being performed along the inclined faces formed at the right side in FIG. 2 while the inclined faces positioned at the left side are spaced apart from each other.

Figure 2A:
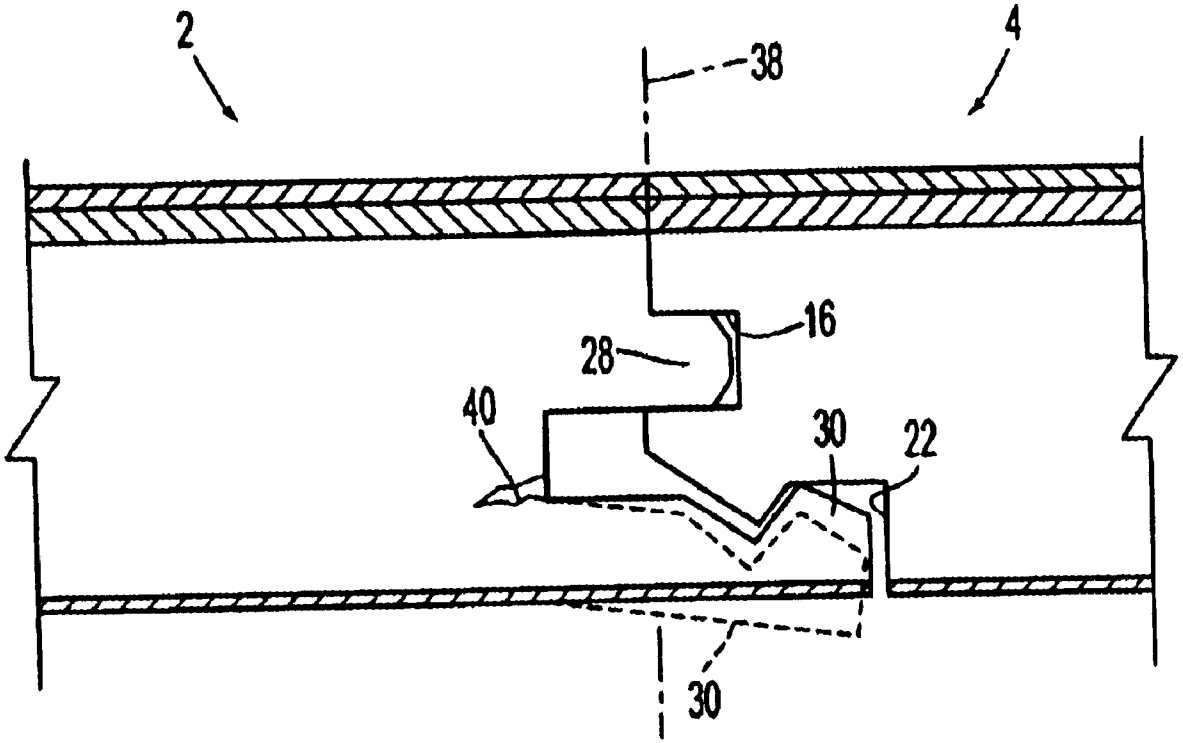
FIG. 2A illustrates the floor panels of FIG. 1 in a non-positively engaged state.

The positions of the projection 24 and of the notch 34 are chosen such that the respective two front faces 14, 26 are flatly pressed against each other in the locked state, so that any gap in the front face area between the two floor panels 2, 4 is minimal. Thus FIG. 2 illustrates a state of positive engagement. The front face of the twistlock 30 is spaced apart from the adjacent front face of the recess 22. Since the depth S of the front recess 32 is greater than the length s of the tongue 28, the bottom of the front recess 32 is also spaced apart from the front face 14 of the floor panel 4 forming the parting plane 38 (FIG. 2, illustration in dot and dash). FIG 2A. shows an example in which a slight gap exists between the projection 24 and the notch 34 such that a slight play exists between the two floor panels 2 and 4. Thus, FIG. 2A illustrates an example of a state of non-positive engagement.

The orientation of the floor panels 2, 4 in vertical direction is performed alone by the groove and tongue joint 28, 16, while the locking and pressing of the floor panels 2, 4 is performed alone by the twistlock 30 interacting with the projection 24, and thus depends on the resilience of the twistlock 30. This can be changed by varying the depth S of the front recess 32 (indicated by broken lines in FIG. 1), so that the resilient deflection of the twistlock 30 and the locking force can easily be adapted as a function of the choice of material and of the conditions of use of the floor.

Even if, in the case of unfavorable conditions, for instance with an overstraining of the twistlock 30, a crack occurs in the area indicated with reference numeral 40, no offset in height has to be feared since the fitting between the groove 16 and the tongue 28 remains unimpaired while at most the locking forces are reduced.

With the conventional solutions, due to the double function of the groove and tongue joint, both the locking and the fitting between the floor panels are neutralized when the lower groove cheek breaks. The invention thus constitutes a substantial improvement of conventional glue-free joints, so that an accurately fitting laying of the floor is guaranteed even with highest strains and even in the case of mistakes in laying.

The method of laying the floor panels 2, 4 as constructed pursuant to the invention is explained in the following by means of FIG. 3. It is assumed that one or several floor panels 2 (4) have already been laid on a floor 42 indicated in dot and dash, with merely the longitudinal side of the panel incorporating the tongue 28 and the twistlock 30 being illustrated in FIG. 3. The floor panel 4 to be added also is placed flatly on the floor 42 and is then shifted in the X-direction (arrow in FIG. 3) until the inclined face 36 gets into contact with the projection 24. Subsequently, a striking block 44 is applied which has a substantially L-shaped cross-section and which rests with its longer leg on the upper side of the floor panel 4 and its shorter leg at least partially encompassing the right front face of the floor panel in FIG. 3. Thus, this short leg is in contact with the tongue 28.

By slight strokes with a hammer 46 on the striking block 44 in the direction of the floor panel 2 already laid, the engagement of the locking elements is performed as illustrated in FIG. 2.

The orientation in longitudinal direction of the panels 2, 4 subsequently is performed by applying the striking block 44 to the narrow side. By applying strokes, the floor panel 4 can be shifted along the longitudinal side of the panels that have already been laid, until the narrow sides are locked with each other.

The concept pursuant to the invention allows for the floor panels 2, 4 to be joined in flat position, i.e. without twisting. Such twisting was necessary with the prior art as initially described. The measures pursuant to the invention thus substantially facilitate laying, so that laying work may also be performed by a non-professional person.

In order to enable a particularly reliable joint of the floor panels 2, 4, joining by gluing may be performed in addition to the locking as explained. This gluing is preferably effected in the groove and tongue area.

Another particular advantage of the construction pursuant to the invention is that the twistlock 30 is formed flush at the lower side of the floor panels 2, 4, so that a flat contact is guaranteed. Since the groove and tongue joint and the locking are provided independently of each other, the two floor panels 2, 4 are guided exactly by the groove and tongue joint during the locking process already. With the prior art initially mentioned, the lower groove cheek, which simultaneously forms the locking member, is resiliently deflected during the locking process so that precise guiding of the locking process pursuant to the invention is not possible.

Since no twisting is required with the locking pursuant to the invention, it remains left to the person laying the panels to determine whether he will first join the long sides or the narrow sides of the floor panels. In the case of locking which requires twisting, the adjacent floor panels first had to be joined along the narrow sides, and subsequently this long board consisting of a plurality of individual floor panels had to be twisted to engage with the floor panel already laid. This is substantially more awkward since the aligning of such long boards is much more difficult than the successive laying of short floor panels.

Figure 4:
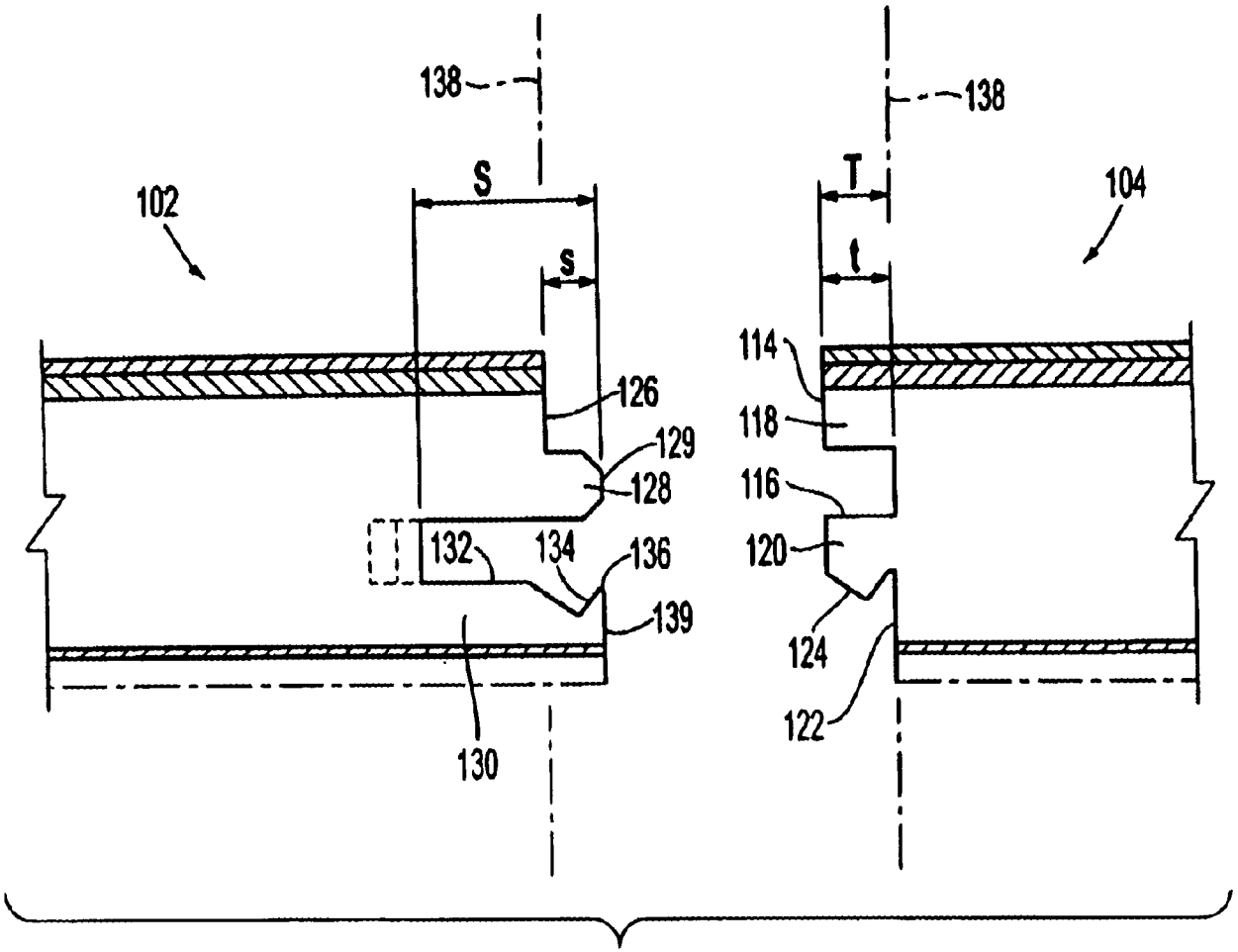
FIG. 4 illustrates another exemplary embodiment of the joint area of two floor panels joined at their long sides.
Figure 5:
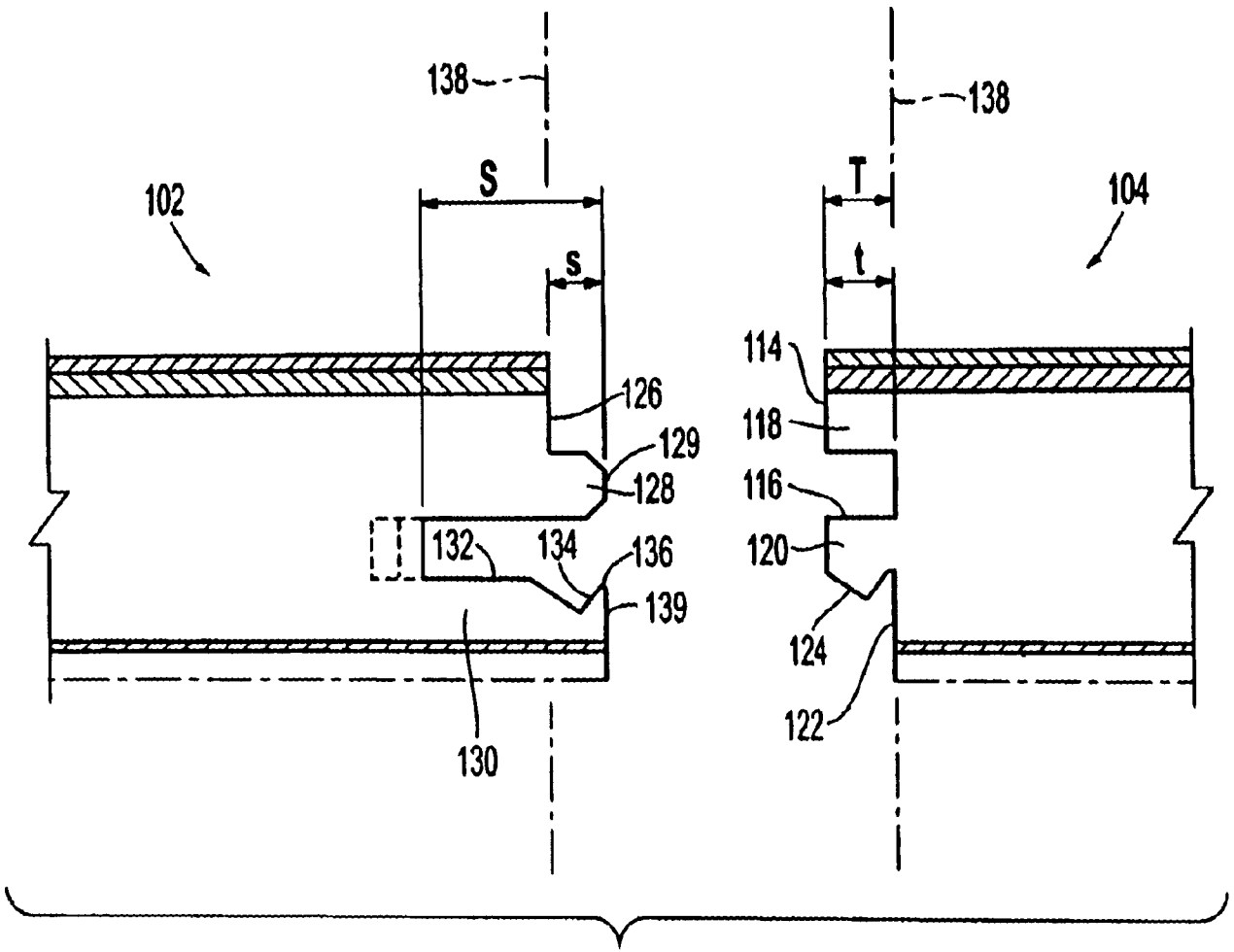
FIG. 5 illustrates the floor panels of FIG. 4 joined at their narrow sides.

In an alternative embodiment, as shown in FIGS. 4 and 5, floor panel 104 is provided with a front face 144, a groove 116, higher groove cheek 118, lower groove cheek 120 and recess 122. The depth t of the groove 116 is substantially the same as the depth T of recess 122. A projection 124 is provided on the lower side of the lower groove cheek 120 and extends downward therefrom.

Also in FIG. 4, a floor panel 102 is provided with a tongue 128 corresponding to groove 116. The tongue 128 projects from front face 126 of the floor panel 102. A twistlock 130 is formed on the floor panel 102, separated from the tongue 128 by a front recess 132. The depth S of the front recess 132 is greater than the length s of the tongue 128, similar to the previously described embodiments as illustrated in FIGS. 1–3, for example. By varying the depth S, the resilience of the twistlock 130 can be adjusted so that the extraction forces for dismantling the floor can be adapted.

FIG. 4 shows the floor panels 102 and 104 joined at their long sides. FIG. 5 shows the floor panels 102 and 104 joined at their short sides.

A front face 139 of the twistlock 130 substantially coincides with a front face 129 of the tongue 128 such that the twistlock 130 extends beyond vertical parting plane 138 only as far or substantially as far as the tongue 128. The twistlock 130 is provided with a notch 134 into which projection 124 of floor panel 104 will seat when the two floor panels are joined; as shown in this embodiment, notch 134 is formed approximately below the front face 126 of the floor panel 102 on the vertical parting plane 138, although the invention is not necessarily limited to this specific arrangement. A sliding face 136 provided on the front of the twistlock 130 facilitates joining of the floor panels 102, 104.

The positions of the projection 124 and the notch 134 are chosen such that the respective front faces 114, 126 are flatly pressed against each other in the locked state, so that any gap in the front face area between the two floor panels 102, 104 is minimal. The front face 139 of the twistlock 130 is spaced apart from the adjacent front face of the recess 122. Since the depth S of the front recess 132 is greater then the length s of the tongue 128, the bottom of the front recess 132 is also spaced apart from the front face 114 of the floor panel 104 forming the parting plane 138.

Figure 3:
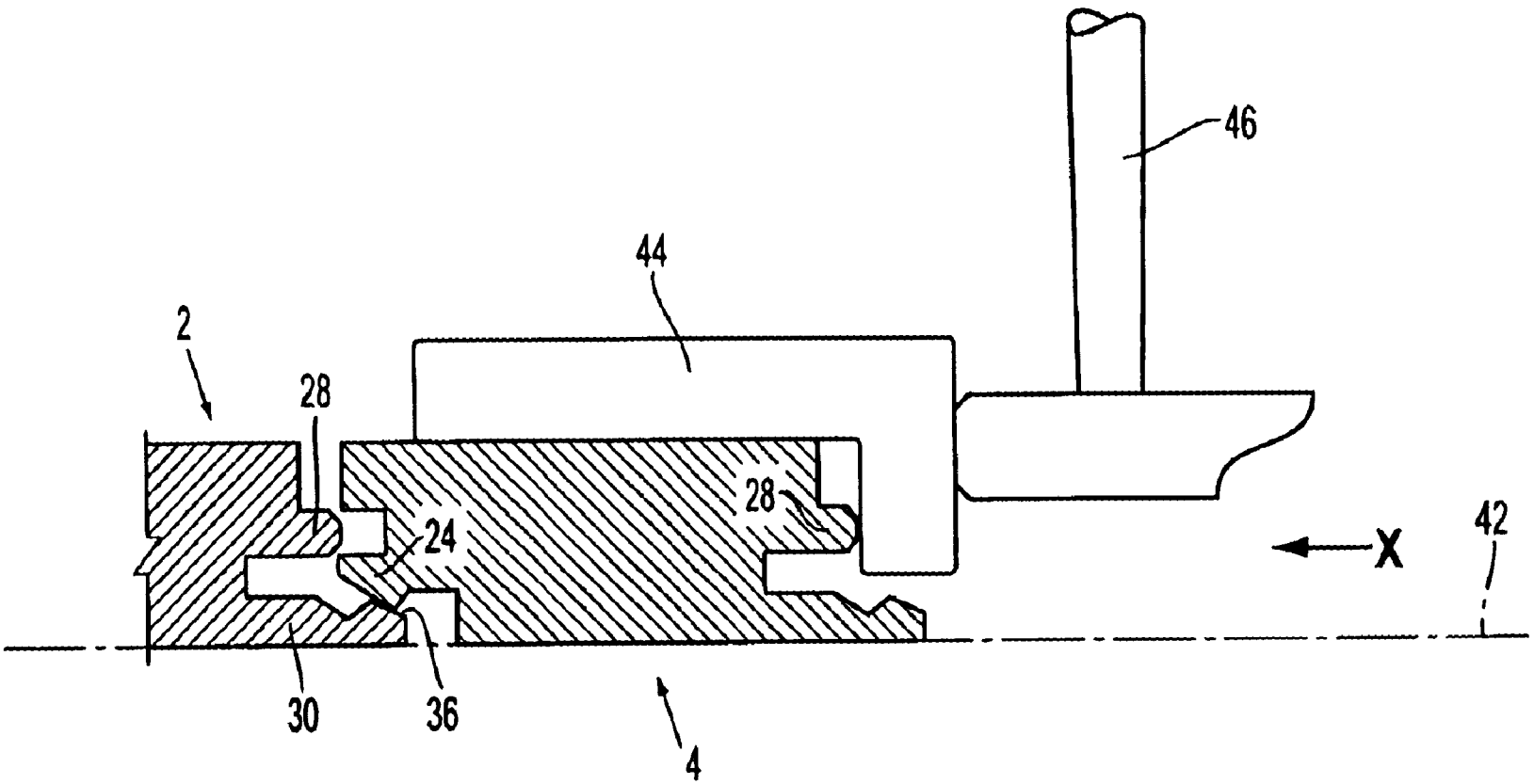
FIG. 3 illustrates a representation to explain the laying process.

Of course at least the same or similar advantages as discussed above, with reference to the exemplary embodiments illustrated in FIGS. 1–3, are evident in the alternative embodiment described herein with reference to FIG. 4. In addition, less material is required in the exemplary embodiment of FIG. 4, and, because the ends of tongue 128 and twistlock 130 are substantially aligned, processing may be easier.

In the exemplary embodiments described above, the twistlock 30 or 130 is formed at the same floor panel end as the tongue 28 or 128. However, the twistlock 30 or 130 could also be formed at the floor panel end provided with the groove 16 or 116, this, however, necessitating the removal of some more material in order to cut the front face free.

Instead of locking via inclined faces, other geometries, for instance rounded faces, vertical faces, etc., could also be used. It may on principle also be imagined to manufacture the twistlock 30, 130 from some other material and to fix it to the panel.

What is disclosed is a joint for two flat structural members, in particular floor panels, wherein a groove and tongue joint is provided functionally separate from locking. This locking is effected by a twistlock of a structural member, said twistlock being spaced apart from the groove and tongue joint and engaging with a correspondingly formed engaging element of the other structural member. The locking is preferably formed both at the longitudinal edges and at the front edges of a rectangular structural member, for instance of a floor panel. The locking allows for a joint of the floor panels in flat position, i.e. without twisting.

What is claimed is:

1. A joint for plate-shaped structural members, for instance floor panels, comprising a groove and tongue joint passing a parting plane between two adjacent structural members, and a locking for fixing the relative position determined by said groove and tongue joint such that relative movement of the structural members in a direction perpendicular to the parting plane is restricted, the locking comprising a twistlock formed on one of the structural members and separated from said groove and tongue joint, said twistlock being positively or non-positively engageable with an engaging element on the other structural member, said tongue and said twistlock extending substantially the same distance beyond said parting plane.

2. The joint according to claim 1, wherein the tongue and the twistlock are provided on the same structural member, the twistlock is provided at a distance to the tongue so as to form a recess between the tongue and the twistlock, and the engaging element is provided at a distance to the groove on the other structural member.

3. The joint according to claim 2, wherein the recess extends inwardly into said same structural member relative to the parting plane, and a depth of the recess is chosen as a function of a desired extraction force for separating the structural members.

4. The joint according to claim 1, wherein the twistlock is provided at a floorside.

5. The joint according to claim 1, wherein a notch is formed on a side of the twistlock facing the tongue, the notch being formed to correspond to a projection of the engaging element as a counterpart.

6. The joint according to claim 5, wherein the notch of the twistlock and the projection of the engaging element both are delimited by inclined faces.

7. The joint according to claim 1, wherein engagement of the twistlock and the engaging element is chosen such that a tension force acts to press the structural members together.

8. The joint according to claim 1, wherein the joint is provided at long and narrow sides of the structural members.

9. The joint according to claim 1, wherein glue joining of the structural members is performed in addition to the positive or non-positive engagement.

10. The joint according to claim 1, wherein a depth, in a direction perpendicular to the parting plane, of a recess between the tongue and the twistlock is greater than a length of the tongue in the direction perpendicular to the parting plane.

11. A joint for plate-shaped structural members, for instance floor panels, comprising a groove and tongue joint passing a parting plane between two adjacent structural members, and a locking for fixing the relative position determined by said groove and tongue joint such that relative movement of the structural members in a direction perpendicular to the parting plane is restricted, the locking comprising a twistlock formed on one of the structural members and separated from said groove and tongue joint, said twistlock being positively or non-positively engageable with an engaging element on the other structural member, said tongue and said twistlock being provided on the same structural member and extending substantially the same distance beyond said parting plane.

12. The joint of claim 11, wherein the twistlock is provided at a distance to the tongue so as to form a recess between the tongue and the twistlock, and the engaging element is provided at a distance to the groove on the other structural member.

13. The joint of claim 12, wherein the recess extends inwardly into said same structural member relative to the parting plane, and a depth of the recess is chosen as a function of a desired extraction force for separating the structural members.

14. The joint according to claim 11, wherein a notch is formed on a side of the twistlock facing the tongue, the notch being formed to correspond to a projection of the engaging element as a counterpart.

15. The joint according to claim 14, wherein the notch of the twistlock and the projection of the engaging element are both delimited by inclined faces.

16. The joint according to claim 11, wherein engagement of the twistlock and the engaging element is chosen such that a tension force acts to press the structural members together.

17. The joint of claim 11, wherein the joint is provided at long and narrow sides of the structural members.

18. The joint according to claim 11, wherein a depth, in a direction perpendicular to the parting plane, of a recess between the tongue and the twistlock is greater than a length of the tongue in the direction perpendicular to the parting plane.

19. A joint for joining adjacent plate-shaped structural members, the joint comprising:

a tongue provided on a first plate-shaped structural member and extending a distance from a parting plane;

a groove provided on a second plate-shaped structural member for receiving the tongue;

a twistlock provided on the first plate-shaped structural member and separated from the tongue by an inwardly extending first recess of variable depth, the twistlock extending a distance from the parting plane substantially the same as the distance the tongue extends from the parting plane, and the twistlock including a notch; and a second recess provided on the second plate-shaped structural member for receiving the twistlock, an upper surface of the recess having a projection corresponding to the notch of the twistlock such that, when the adjacent plate-shaped structural members are joined, the groove receives the tongue, the second recess receives the twistlock, and the notch receives the projection.

20. The joint according to claim 19, wherein the twistlock is below the tongue.

21. The joint according to claim 19, wherein the notch is V-shaped.

22. The joint according to claim 19, wherein the depth of the inwardly extending first recess is set according to a desired extraction force for separating the adjacent structural members.

23. The joint according to claim 19, wherein the variable depth is greater than the distance the tongue extends from the parting plane.

* * * * *